US009927189B2

(12) United States Patent
Army, Jr. et al.

(10) Patent No.: US 9,927,189 B2
(45) Date of Patent: Mar. 27, 2018

(54) AIRCRAFT PRECOOLER HEAT EXCHANGER

(75) Inventors: Donald E. Army, Jr., Enfield, CT (US); Christina W. Millot, Wilbraham, MA (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 1634 days.

(21) Appl. No.: 13/186,577

(22) Filed: Jul. 20, 2011

(65) Prior Publication Data

US 2013/0020047 A1 Jan. 24, 2013

(51) Int. Cl.

| | |
|---|---|
| ***F28F 1/10*** | (2006.01) |
| ***F28F 1/00*** | (2006.01) |
| ***F28F 21/08*** | (2006.01) |
| ***F28F 1/14*** | (2006.01) |
| *F28D 21/00* | (2006.01) |

(52) U.S. Cl.

CPC ..... *F28F 21/086* (2013.01); *F28F 1/14* (2013.01); *F28F 21/087* (2013.01); *F28D 2021/0021* (2013.01); *F28F 2275/20* (2013.01); *F28F 2280/02* (2013.01)

(58) Field of Classification Search

CPC ..... F28F 21/086; F28F 21/087; F28F 1/14; F28F 2275/20; F28F 2280/02; F28D 2021/0021

USPC ..... 62/401, 402, 515, 87, 323.1; 165/180, 165/177, 158, 157

See application file for complete search history.

(56) References Cited

U.S. PATENT DOCUMENTS

| | | | | |
|---|---|---|---|---|
| 2,485,088 | A * | 10/1949 | Ellis | 165/83 |
| 2,526,618 | A * | 10/1950 | Darrieus | F04F 13/00 116/DIG. 22 |
| 3,372,743 | A * | 3/1968 | Pall et al. | 165/166 |
| 4,924,938 | A * | 5/1990 | Plaschkes | 165/158 |
| 6,273,180 | B1 * | 8/2001 | Joshi | F28D 7/06 165/11.1 |
| 6,629,428 | B1 * | 10/2003 | Murry | 62/401 |
| 6,681,592 | B1 | 1/2004 | Lents et al. | |
| 6,796,527 | B1 | 9/2004 | Munoz et al. | |
| 7,757,502 | B2 | 7/2010 | Merritt et al. | |
| 2002/0121103 | A1 * | 9/2002 | Udobot | B64D 13/06 62/402 |
| 2005/0126769 | A1 * | 6/2005 | Pohlman et al. | 165/166 |
| 2006/0096745 | A1 * | 5/2006 | Cox | F28D 7/026 165/156 |
| 2007/0101731 | A1 * | 5/2007 | Bayt et al. | 62/7 |
| 2010/0294471 | A1 * | 11/2010 | Oudjedi | F28D 7/0066 165/164 |
| 2010/0313591 | A1 | 12/2010 | Lents et al. | |

FOREIGN PATENT DOCUMENTS

JP 2009047395 A * 3/2009

* cited by examiner

*Primary Examiner* — Kun Kai Ma
(74) *Attorney, Agent, or Firm* — Cantor Colburn LLP

(57) ABSTRACT

A heat exchanger is provided. The heat exchanger includes a first member having an inlet at a first end and a first flange at an opposite end. The first member is made from a nickel-chromium material. A second member is provided having a second flange one end coupled to the first flange. The second member further having an outlet on a second end opposite the second flange. The second member is made from titanium.

18 Claims, 2 Drawing Sheets

AIRCRAFT PRECOOLER HEAT EXCHANGER

BACKGROUND OF THE INVENTION

The subject matter disclosed herein relates to a heat exchanger and in particular to a bleed flow precooler for use with an aircraft environmental control system.

Aircraft have power systems that are comprised of several components, such as the engine, the environmental control system and a thermal management system. These systems are designed relatively independently from each other with power being transferred from one system to another.

The environmental control system supplies pressurized air to the cabin and flight deck. This is typically accomplished by using an air cycle machine. Air, referred to as bleed air, is removed from the compressor stage of the engine. The bleed air leaves the engine at a high temperature (e.g. greater than 1000° F.) and needs to be cooled prior to further use. The bleed air extracted from the engine is typically cooled by an engine or pylon mounted precooler (HX) that uses engine fan air as the heat sink. The precooler keeps the temperatures of the bleed air ducts connected to the environmental control system below the auto ignition temperature of jet fuel/fuel vapors that may leak from adjacent wing and center fuel tanks. The bleed air is then further compressed in the compressor section of an air cycle machine. Additional cooling of the bleed air may be performed in a secondary heat exchanger, once again using ram air. The bleed air is then typically expanded to the desired pressure across the turbine section. The energy generated during the expansion process may be used to drive the compressor stage and also further drop the temperature of the bleed air. The cooled bleed air is mixed with cabin recirculation air to maintain the temperature of the air at a desired level.

It should be appreciated that while the environmental control system is necessary for operation of the aircraft, the weight of the system may have a less than desirable impact on the fuel performance or carrying capacity of the vehicle. Accordingly, while existing environmental control systems are suitable for their intended purposes the need for improvement remains, particularly in providing a lower weight heat exchanger.

BRIEF DESCRIPTION OF THE INVENTION

According to one aspect of the invention, a heat exchanger is provided. The heat exchanger includes a first member having an inlet at a first end and a first flange at an opposite end. The first member is generally hollow to define a first flow path between the inlet and the first flange, the first member being made from a nickel-chromium material. A second member is provided having a second flange at an end. The second flange is coupled to the first flange, the second member further having an outlet on a second end opposite the second flange, the second member being generally hollow to define a second flow path between the second flange and the outlet, the second member being made from titanium.

According to another aspect of the invention, a heat exchanger system for an aircraft having an engine having a fan stage and a compressor stage is provided. The heat exchanger system includes a first conduit configured to receive bleed air from the compressor stage and an environmental control system. A precooler heat exchanger is also provided with a first member having an inlet at a first end fluidly coupled to the first conduit, the first member being made from a nickel-chromium material. A second member is fluidly coupled in series to the first member, the second member having an outlet fluidly coupled to the environmental control system, the second member being made from titanium.

According to yet another aspect of the invention, a method of cooling air for an aircraft environmental system is provided. The method includes providing a first member having an inlet at a first end, the first member being made from a nickel-chromium material. A second member is fluidly coupled in series to the first member, the second member further having an outlet on a second end, the second member being made from titanium. Wherein the first member is configured to receive air at a first temperature at about 1058° F. and cool the air to a second temperature of less than 830° F. at a flange at an opposite end of the inlet.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Reducing weight in aircraft components is desirable as the reductions allow for improved fuel economy and increased carrying capacity of the aircraft. Embodiments of the present invention provide a precooler heat exchanger that provides advantages in having reduced weight. Embodiments of the invention provide for precooler heat exchanger having a first stage made from a first material capable of operating at very high air temperatures and a second stage made from a second lighter weight material.

Figure 1:
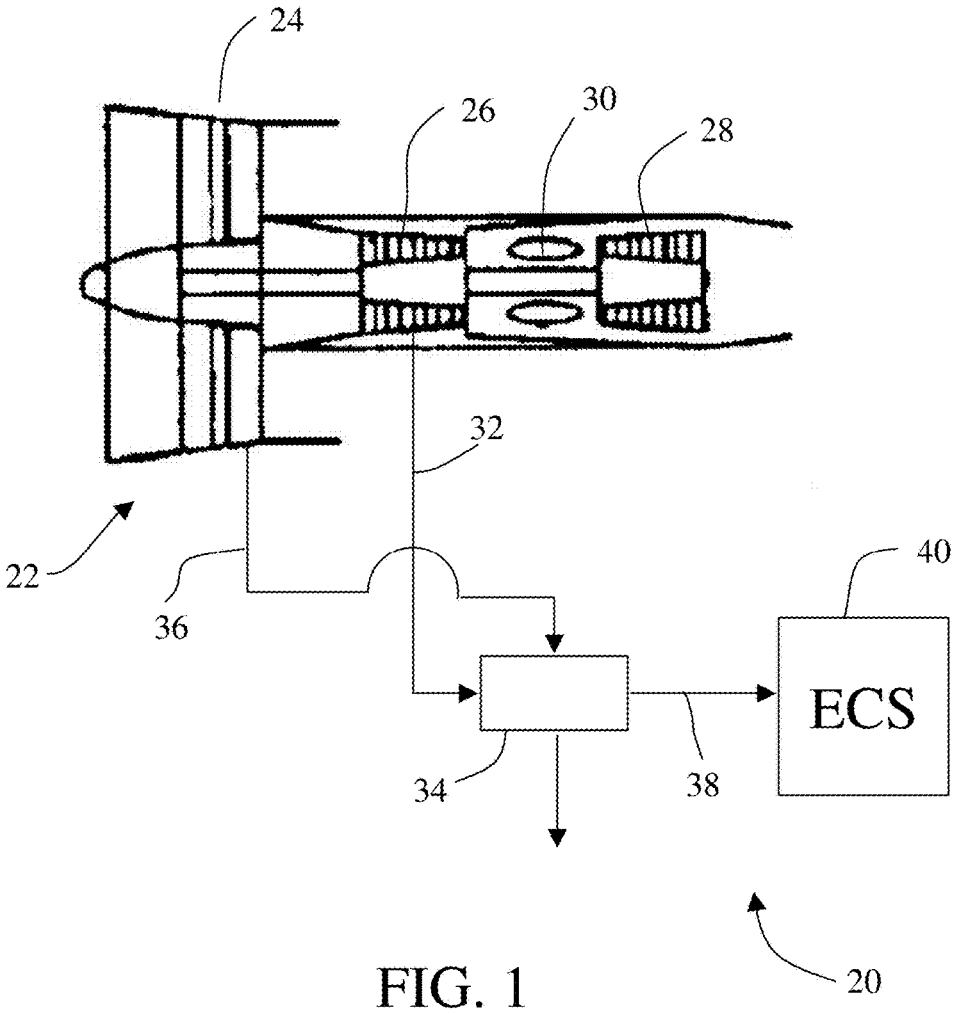
FIG. 1 is a schematic view of an aircraft engine and environmental control system in accordance with an embodiment of the invention.

FIG. 1 depicts an engine 22 that includes a fan section 24, a compressor section 26, and a turbine section 28 for an aircraft. The engine 22 receives air through the fan 24 and compresses the air in the compressor 26. The air is combined with a fuel and burned in a combustor 30 that increases the temperature and pressure of the air. The heated air is then expanded through the turbine to generate thrust for operating the aircraft.

A conduit 32 is coupled to the compressor section 26 to extract air, sometimes referred to as bleed air, from the engine 22. Due to compression of the air, the bleed air may be as high as 1100° F. (593.3 C) depending on operation of the engine 22. The bleed air flows to a precooler heat exchanger 34, which reduces the temperature of the air to make it suitable for use by other components. In the exemplary embodiment, the precooler heat exchanger 34 reduces the bleed air temperature from about 1050° F. (565.5 C) to about 450° F. (232.2 C). As will be discussed in more detail below, the precooler heat exchanger 34 includes components fabricated from different materials that reduce the weight of the precooler heat exchanger 34 while still allowing for operation at the high bleed air temperatures.

A second conduit 36 is coupled to the fan stage 24 to draw cooler air from the engine 22 prior to compression. The second conduit 36 flows the air from fan stage 24 over and about the precooler heat exchanger 34. The flow of the air from conduit 36 transfers thermal energy from the precooler heat exchanger 34 and disburses it to the environment. In the exemplary embodiment, the flow of air from conduit 36 is arranged in a cross-flow configuration with the precooler heat exchanger 34. It should be appreciated that the conduit 36 may also be arranged in a counter-flow or parallel flow configuration with the precooler heat exchanger 34 to provide the desired heat exchange performance.

The cooled bleed air from the precooler heat exchanger 34 is transferred via a conduit 38 into the balance of environmental control system 40. The environmental control system 40 may include one or more turbine and compressor devices that further cool and extract energy from the bleed energy air. The environmental control system 40 may also include ancillary devices including valves, water separators and air mixers for example. The conduits 32, 36, precooler heat exchanger 34, and environmental control system 40 may be collectively referred to as a heat exchanger system 20 in this example. One skilled in the art may adapt the precooler heat exchanger 34 to be used with any suitable prior art environmental control system such as that described in commonly owned U.S. Pat. No. 6,817,575 entitled "Integrated System for Providing Aircraft Environmental Control" for example.

Figure 2:
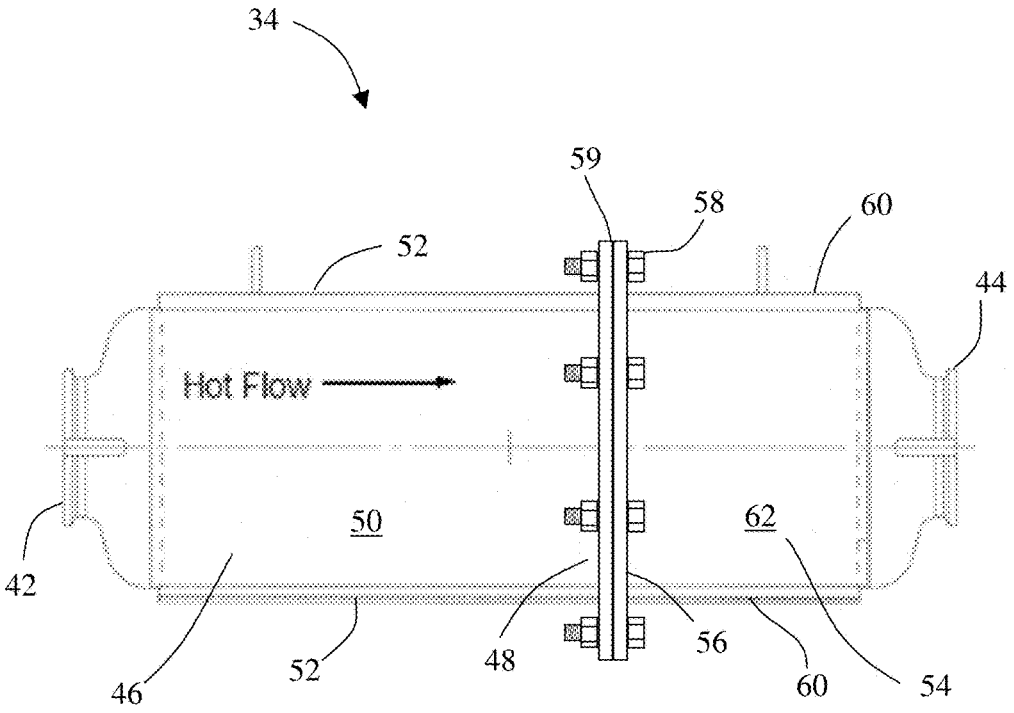
FIG. 2 is a side view of a precooler heat exchanger for use with the environmental control system of FIG. 1.

Referring now to FIG. 2 a precooler heat exchanger 34 is shown having an inlet 42 and an outlet 44. The precooler heat exchanger 34 includes a first member 46 on the inlet side. The first member 46 has a flange 48 opposite the inlet 42. The first member 46 is substantially hollow allowing for bleed air to flow along a flow path from the inlet 42 to the flange 48. The first member 46 has a generally rectangular outer surface 50. A plurality of fins 52 are disposed on the outer surface 50 to facilitate the transfer of thermal energy from the bleed air to the air in conduit 36. In the exemplary embodiment, the first member 46 is made from an austenitic nickel-chromium based superalloy material, such as Inconel® manufactured by Special Metals Corporation, having a density of about 0.30-0.32 lb/in$^3$ (8301-8858 kg/m$^3$).

The precooler heat exchanger 34 includes a second member 54 on the outlet 44 side. The second member 54 includes a flange 56 that is coupled to the flange 48 by a plurality of bolts 58. The flanges 48, 56 may include a seal 59, such as a C-seal or a crush seal for example. The second member 54 is substantially hollow allowing for bleed air to flow along a flow path from the flange 56 to the outlet 44. The second member 54 includes a generally rectangular outer surface 62. A plurality of fins 60 are disposed on the surface 62 to further facilitate the transfer of thermal energy from the bleed air within the second member 54 to the air in conduit 36. It should be appreciated that the bleed air flows through the first member 46 and second member 54 in a series arrangement while the fan air from conduit 36 flows across the first member 46 and second member 54 in a parallel arrangement.

In the exemplary embodiment, the second member 54 is made from a commercially pure titanium material. As used herein, commercially pure titanium has a purity equal to or greater than about 99% and has a density of 0.16 lb/in$^3$ (4429 kg/m$^3$). The use of commercially pure titanium provides advantages in reducing the weight over an alloyed titanium (about 45% lighter) while having a higher thermal conductivity (11-13 Btu/(hr ° F. ft), 19.04-22.5 W/(m K)) than Inconel (8.4 Btu/(hr ° F. ft), 14.54 W/(m K)).

During operation, the bleed air is removed from the engine 22 at a temperature up to about 1160° F. (626.7 C) and passed through the conduit 32 to the inlet 42 of precooler heat exchanger 34. As the bleed air passes through the first member 46, thermal energy is extracted and transferred through the fins 52 to the air stream from conduit 36. The temperature of the bleed air drops from about 1160° F. (626.7 C) to less than 830° F. (443.3 C) at the flange joint. In the exemplary embodiment, the length of the first member 46 is equal to or greater than about 60% of the total length of the first member 46 and second member 54 to achieve this temperature drop. In one embodiment, the length of the first member 46 is about 327 millimeters. As the bleed air continues to flow in series through the second member 54 additional thermal energy will be transferred through the fins 60 to the air in conduit 36. The temperature of the bleed air will decrease from about 830° F. (443.3 C) to about 465° F. (240.6 C) at the outlet 44. In the exemplary embodiment, the length of the second member 54 is about 40% of the total length of the first member 46 and second member 54 to achieve this temperature drop. In one embodiment, the length of the second member 54 is about 218 millimeters.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger comprising:

a first member having an inlet at a first end and a first flange at an opposite end, the first member being generally hollow to define a first flow path between the inlet and the first flange, the first member being made from a nickel-chromium material; and a second member having a second flange at an end, the second flange being directly coupled to the first flange, the second member further having an outlet on a second end opposite the second flange, the second member being generally hollow to define a second flow path in series with the first flow path and arranged between the second flange and the outlet, the second member being made from titanium.

2. The heat exchanger of claim 1 wherein the first member includes a first outer surface with a plurality of first fins disposed thereon.

3. The heat exchanger of claim 2 wherein the second member includes a second outer surface with a plurality of second fins disposed thereon.

4. The heat exchanger of claim 3 wherein the second member is made from commercially pure titanium.

5. The heat exchanger of claim 3 wherein the first member has a length equal to or greater than 60% of the total length of the first member and second member.

6. A heat exchanger system for an aircraft having an engine having a fan stage and a compressor stage, the heat exchanger system comprising:

a first conduit configured to receive bleed air from the compressor stage;

an environmental control system; and a precooler heat exchanger comprising:

a first member having a rectangular outer surface and having an inlet at a first end fluidly coupled to the first conduit, the first member having a first flange on an end opposite the first end, the first member being made from a nickel-chromium material, the first member configured to reduce a temperature of the bleed air from an inlet temperature to less than 830° F. at the first flange; and a second member having a rectangular outer surface and fluidly coupled in series to the first member, the second member having an outlet fluidly coupled to the environmental control system, the second member having a second flange arranged on an end opposite the outlet and directly coupled to the first flange the second member being made from titanium, the second member configured to reduce the temperature of the bleed air to 465° F. at the outlet.

7. The heat exchanger system of claim 6 further comprising a second conduit configured to receive air from the fan stage at a third end and flow the air across the first member and second member in parallel.

8. The heat exchanger system of claim 7 wherein the first member includes a first outer surface with a plurality of first fins disposed thereon.

9. The heat exchanger system of claim 8 wherein the second member includes a second outer surface with a plurality of second fins disposed thereon.

10. The heat exchanger system of claim 9 wherein the second conduit is arranged to flow the air across the plurality of first fins and the plurality of second fins.

11. The heat exchanger system of claim 10 wherein the second member is made from commercially pure titanium.

12. The heat exchanger system of claim 10 wherein the second member is made from a titanium alloy.

13. A method of cooling air for an aircraft environmental system, the method comprising:

providing a first member having an inlet at a first end and a first flange at an opposite end, the first member being made from a nickel-chromium material; and providing a second member fluidly coupled in series to the first member by a second flange, the second member further having an outlet on a second end, the second member being made from titanium;

wherein the first member is configured to receive air at a first temperature at 1058° F. and cool the air to a second temperature of less than 830° F. at a flange at an opposite end of the flange and the second member is configured to cool the air to a third temperature of 465° F. at the outlet.

14. The method of claim 13 further comprising flowing air in parallel across the first member and the second member.

15. The method of claim 14 further comprising providing a plurality of first fins disposed on a first outer surface of the first member.

16. The method of claim 15 further comprising providing a plurality of second fins disposed on a second outer surface of the second member.

17. The method of claim 16 wherein the second member is made from commercially pure titanium.

18. The method of claim 13 wherein the second member is configured to receive air at the second temperature and cool the air to the third temperature of less than 465° F. at the outlet.

* * * * *